US005097775A

United States Patent [19]

Ogawa et al.

[11] Patent Number: 5,097,775

[45] Date of Patent: Mar. 24, 1992

[54] DEVICE FOR STRETCHING A THREAD AND THREADING A NEEDLE ON A SEWING MACHINE

[75] Inventors: Masao Ogawa; Masayuki Seki, both of Nagoya, Japan

[73] Assignee: Brother Kogyo Kabushiki Kaisha, Japan

[21] Appl. No.: 583,316

[22] Filed: Sep. 17, 1990

[30] Foreign Application Priority Data

Oct. 27, 1989 [JP] Japan ..... 1-281469

[51] Int. Cl.[5] ..... D05B 87/02

[52] U.S. Cl. ..... 112/225

[58] Field of Search ..... 112/220, 224, 225, 237, 112/238, 240, 241, 254, 284, 302; 223/99

[56] References Cited

U.S. PATENT DOCUMENTS

| | | | |
|---|---|---|---|
| 212,534 | 2/1879 | Berry | 112/224 |
| 893,698 | 7/1908 | Battey | 112/225 |
| 2,767,671 | 10/1956 | Shapiro | 112/225 |
| 2,815,727 | 12/1957 | Clauss et al. | 112/225 |
| 2,910,029 | 10/1959 | Herbst | 112/225 |
| 3,308,778 | 3/1967 | Nakajima | 112/225 |
| 4,300,463 | 11/1981 | Morimoto | 112/225 |
| 4,651,660 | 3/1987 | Oshima et al. | 112/225 |

FOREIGN PATENT DOCUMENTS 63-89194 4/1988 Japan .

*Primary Examiner*—Werner H. Schroeder
*Assistant Examiner*—Ismael Izaguirre
*Attorney, Agent, or Firm*—Oliff & Berridge

[57] ABSTRACT

A threading device comprising a stretching member, a moving member, a threading member and an actuator. The actuator receives threading instructions and drives the moving member. The moving member moves the thread stretched by the stretching member to the front or the rear of the eye in the needle. The threading member threads the eye with the thread positioned in front or at the rear of the eye. The actuator can thus control the movement of the moving member. The thread can securely be positioned in a given position in front or at the rear of the eye, and the threading member can accurately thread the eye in the needle.

18 Claims, 8 Drawing Sheets

DEVICE FOR STRETCHING A THREAD AND THREADING A NEEDLE ON A SEWING MACHINE

BACKGROUND OF THE INVENTION

This invention relates to a threading device on a sewing machine for stretching thread in front or at the rear of an eye in a needle and threading the eye with taut thread.

Such threading device is disclosed in Japan Published Unexamined Patent Application No. S63-89194. The threading device includes a stretching member for stretching out thread, a moving member for moving the thread stretched by the stretching member to the front or the rear of an eye in a needle, an operating member for manually operating the moving member, and a threading member such as a threading hook or a threading rod for threading the needle.

However, in the related-art reference, the force, speed and the like of manual operation of the operating member change the position or tension of the thread in front or at the rear of the eye. When the thread cannot reach the operating range of the threading hook or the threading rod, threading operation fails. When the operation amount of the operating member comes short, the momentum of the thread moved by the moving member is insufficient. As a result, the thread cannot reach a given position in front or at the rear of the eye, and the threading hook cannot catch thread.

SUMMARY OF THE INVENTION

An object of the invention is to provide a threading device for sufficiently stretching a thread in front or at the rear of an eye in a needle and securely threading the needle.

To attain this or other objects, the invention provides a threading device comprising a stretching member for stretching out thread to a given length, a moving member for moving and positioning the thread stretched by the stretching member in front or at the rear of an eye in a needle, and a threading member for threading the eye with the thread stretched in front or at the rear of the eye. The threading device also includes an actuator for receiving a threading instruction and driving the moving member.

DETAILED DESCRIPTION OF THE PREFERRED EMBODIMENT

Figure 1:
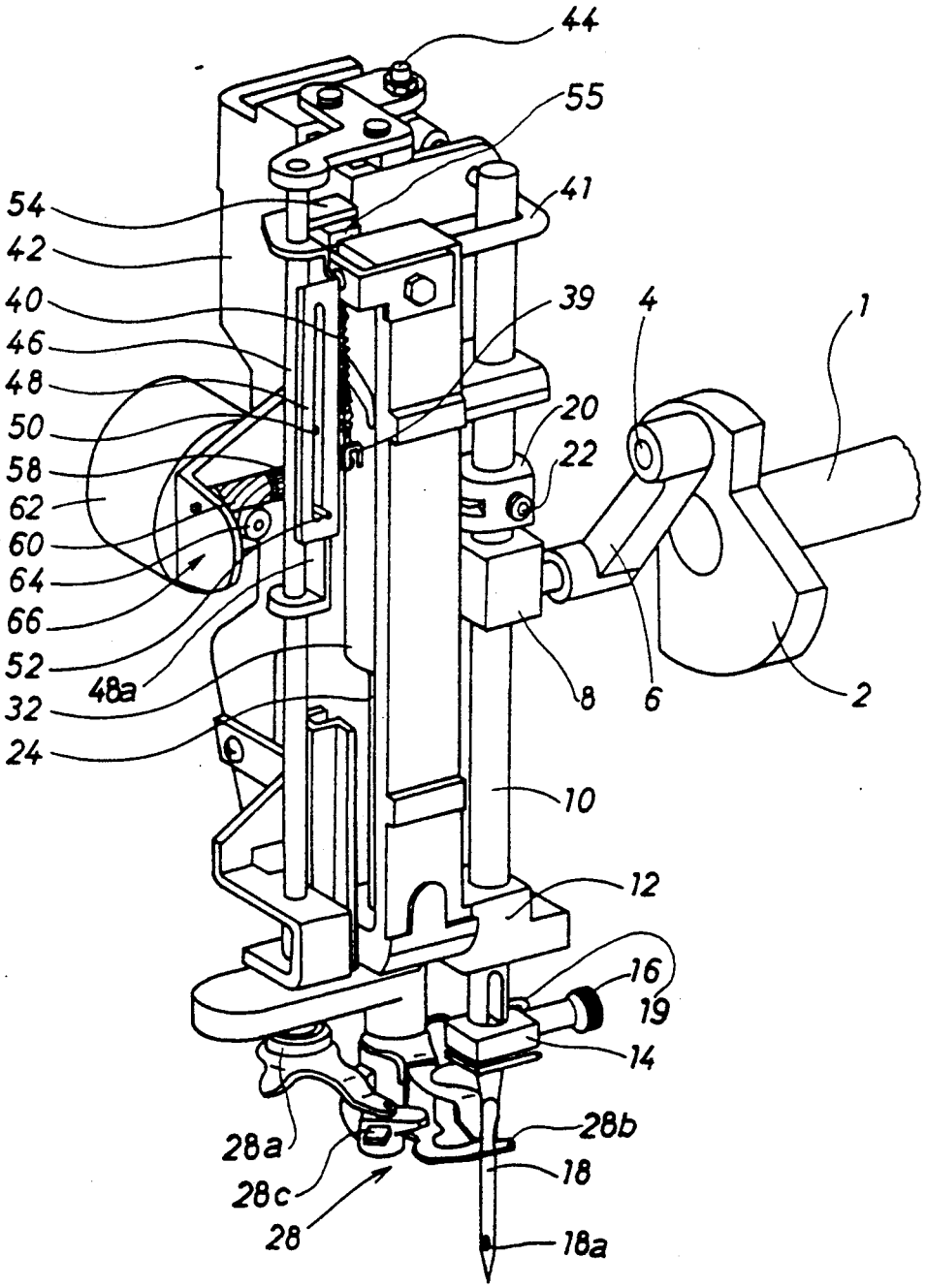
FIG. 1 is a perspective view of a threading device on a sewing machine for an embodiment of this invention.

As shown in FIG. 1, a device for threading a needle on a sewing machine is connected to an arm shaft 1. The arm shaft 1 is driven and rotated through a sewing-machine motor (not shown). A crankpin 4 is set on a counterbalance 2 on the arm shaft 1. One end of a connecting rod 6 is rotatably inserted into the crankpin 4, and a needle-bar connecting stud 8 is rotatably inserted into the other end of the connecting rod 6. The needle-bar connecting stud 8 is slidably engaged on a needle bar 10. A needle bar support 12 supports the needle bar 10 such that the needle bar 10 can vertically slide. A needle 18 is attached through a needle connecting stud 14 and a clamp screw 16 to the lower end of the needle bar 10. A thread guide 19 adjoins the needle connecting stud 14 so as to guide thread 17 into an eye 18*a* in the needle 18. A positioning stopper 20 is secured through a screw 22 onto the needle bar 10 at a predetermined position above the needle-bar connecting stud 8. A projection 20*a* projects from the positioning stopper 20 perpendicularly to the axial direction of the needle bar 10.

Figure 2:
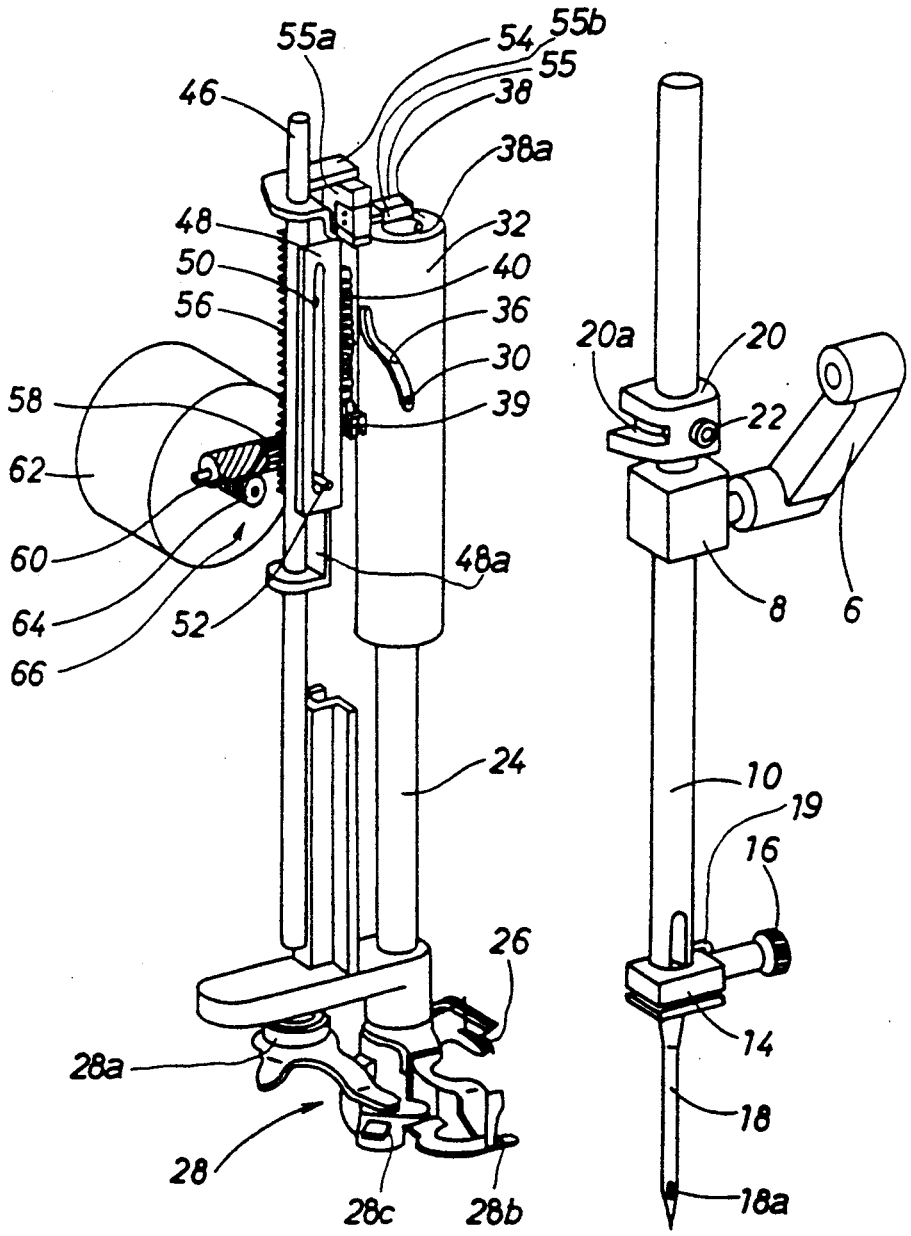
FIG. 2 is a perspective view of a disassembled main portion of the device shown in FIG. 1.

As shown in FIG. 1, a threading rod 24 is provided in parallel with the needle bar 10 on the needle bar support 12. The threading rod 24 can rotate about its axis and slide vertically. As shown in FIG. 2, the threading rod 24 has a threading hook 26 on its lower end. When the threading rod 24 rotates about its axis, the threading hook 26 is rotated through a known linkage 28 toward the front of the eye 18*a* in the needle 18.

Figure 3:
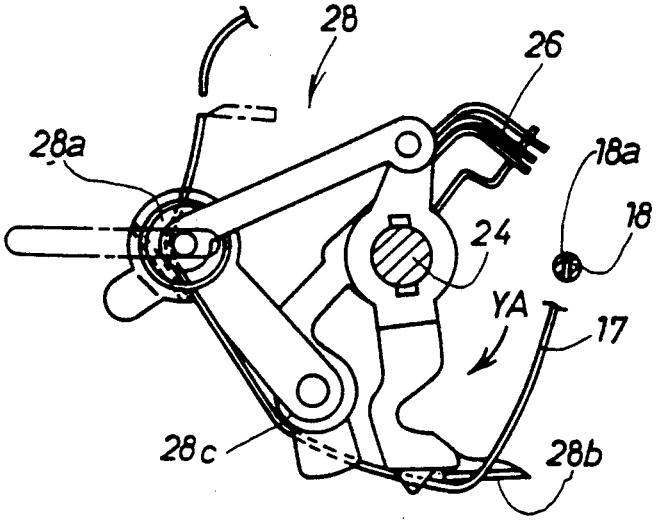
FIGS. 3 through 8 are explanatory views illustrating threading operation.

As shown in FIG. 3, the linkage 28 includes a pivot 28*a* for holding the tip of the thread 17 at a predetermined pressure, a hook 28*b* for catching the thread 17 guided via the thread guide 19, and a hold 28*c* for holding the thread 17 between the pivot 28*a* and the hook 28*b*.

As described later, the linkage 28 and the threading hook 26 in cooperation thread the eye 18*a* in the needle 18 with the thread 17.

Figure 4:
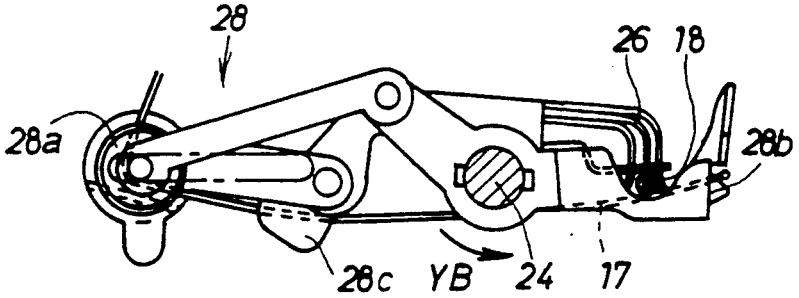
Figure 6:
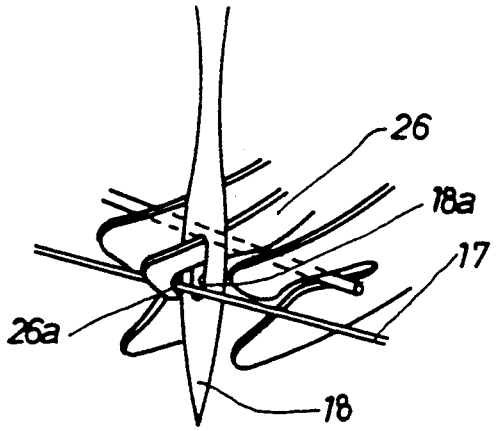

When the threading rod 24 rotates in the direction shown by an arrow YA in FIG. 3, the threading hook 26 is rotated toward the rear of the eye 18*a* in the needle 18. Subsequently, as shown in FIG. 4, the threading hook 26 comes through the eye 18*a*. At the same time, the hook 28*b* is rotated toward the front of the eye 18*a*, and the pivot 28*a* moves in the direction away from the needle 18, thereby stretching the thread 17 in front of the eye 18*a*. Therefore, as shown in FIG. 6, the taut thread 17 is caught in a barb 26*a* of the threading hook 26.

Figure 5:
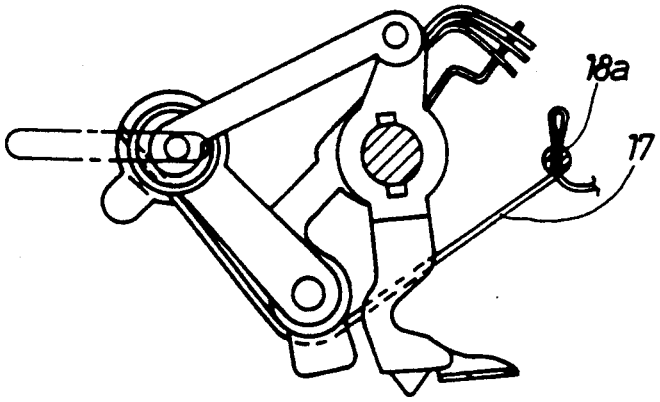
Figure 7:
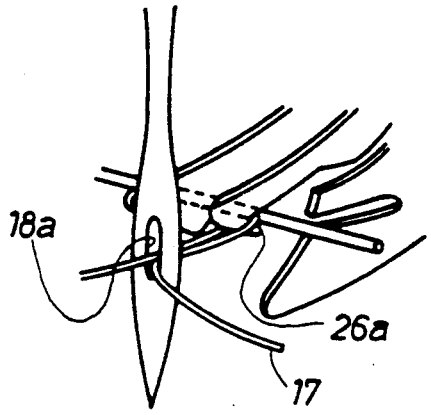
Figure 8:
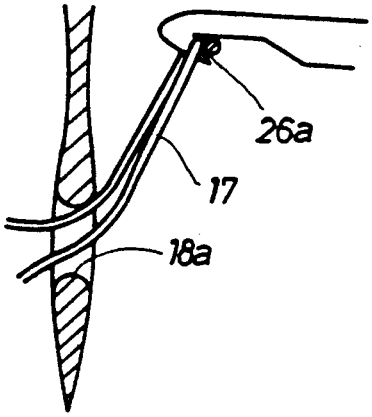

As shown by an arrow YB in FIG. 4, when the threading rod 24 is rotated in the direction opposite to the arrow YA, as shown in FIGS. 7 and 8, the threading hook 26 catches the thread 17 and comes off the eye 18*a*. As shown in FIG. 5, the thread 17 is through the eye 18*a*.

Figure 9:
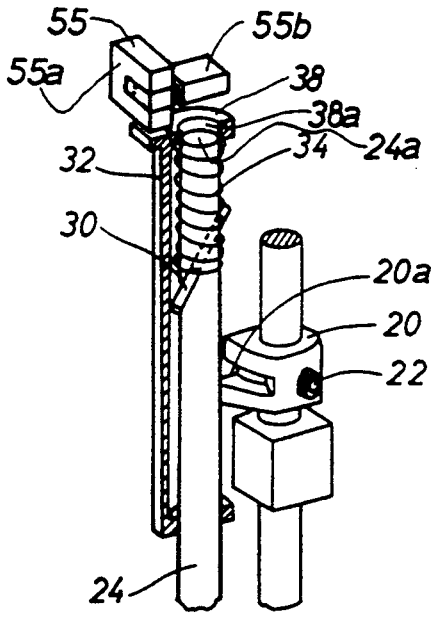
FIG. 9 is a partial perspective view near a positioning stopper for the embodiment.

As shown in FIG. 9, an actuating pin 30 is inserted and secured in its axial direction through the upper part of the threading rod 4. When the threading rod 24 lowers, the actuating pin 30 lowers and contacts the projection 20*a* of the positioning stopper 20. The positioning stopper 20 is secured through the screw 22 to the predetermined position of the needle bar 10 so that when the actuating pin 30 contacts the projection 20*a*, the threading hook 26 is lowered to the eye 18*a* in the needle 18.

As shown in FIG. 9, an actuating rod 32 is slidably inserted onto the threading rod 24, and a compression spring 34 is interposed between the actuating pin 30 and the actuating rod 32. As shown in FIG. 2, an S-shaped guide slot 36 extends upward in the outer periphery of the actuating rod 32. One end of the actuting pin 30 engages the guide slot 36. A contact surface 38 is formed on the upper end of the actuating rod 32 and projects along the radius of the threading rod 24. A hook 39 is formed on the outer periphery of the actuating rod 32. A spring 40 extends between the hook 39 and a hook (not shown) formed as one piece with a moving board 48. The spring 40 exerts an upward force on the actuating rod 32.

As shown in FIG. 1, one end of an L-shaped member 41 is rotatably inserted into the upper end of the needle bar support 12. The other end of the L-shaped member 41 is rotatably attached through a screw 44 into a threading housing 42 secured to a sewing-machine housing (not shown). A guide bar 46 is secured onto the threading housing 42 in parallel with the threading rod 24. A moving board 48 is slidably attached to the guide bar 46, separately from the actuating rod 32.

The moving board 48 includes a slot 50 extending along the sliding direction of the moving board 48. A pin 52 on the guide bar 46 engages the slot 50, thus preventing the moving board 48 from rotating. A projection 54 is formed on the upper end of the moving board 48. As shown in FIG. 2, a reverse switch 55 is secured to the underside of the projection 54, such that, as shown in FIG. 9, when the moving board 48 slides down toward the needle 18, a switch body 55*a* contacts the contact surface 38. An operating portion 55*b* of the reverse switch 55 is arranged above an opening 38*a* in the contact surface 38. When the threading rod 24 protrudes from the opening 38*a* of the contact surface 38, and an upper end 24*a* of the threading rod 24 pushes the operating portion 55*b* of the reverse switch 55, the reverse switch 55 turns on.

When the actuating rod 32 slides down, the threading rod 24 rotates in the direction shown by the arrow YA in FIG. 3, and the threading hook 26 is rotated toward the eye 18*a*, the upper end 24*a* of the threading rod 24 presses the operating portion 55*b* of the reverse switch 55, thereby turning on the reverse switch 55.

As shown in FIG. 2, a flat piece 48*a* extends backward perpendicularly to the front surface having the slot 50 of the moving board 48. A rack 56 is provided at the side of the flat piece 48*a* of the moving board 48. The teeth of the rack 56 are formed transverse to the sliding direction of the moving board 48. The rack 56 meshes with a pinion 58 rotatably supported on the threading housing 42. The pinion 58 and a helical gear 60 form one member and are rotatably supported on the threading housing 42. A worm gear 64 is attached to a rotating shaft of a pulse motor 62 on the threading housing 42 and meshes with the helical gear 60. The worm gear 64, the helical gear 60, the pinion 58 and the rack 56 compose a transmission 66.

Figure 10:
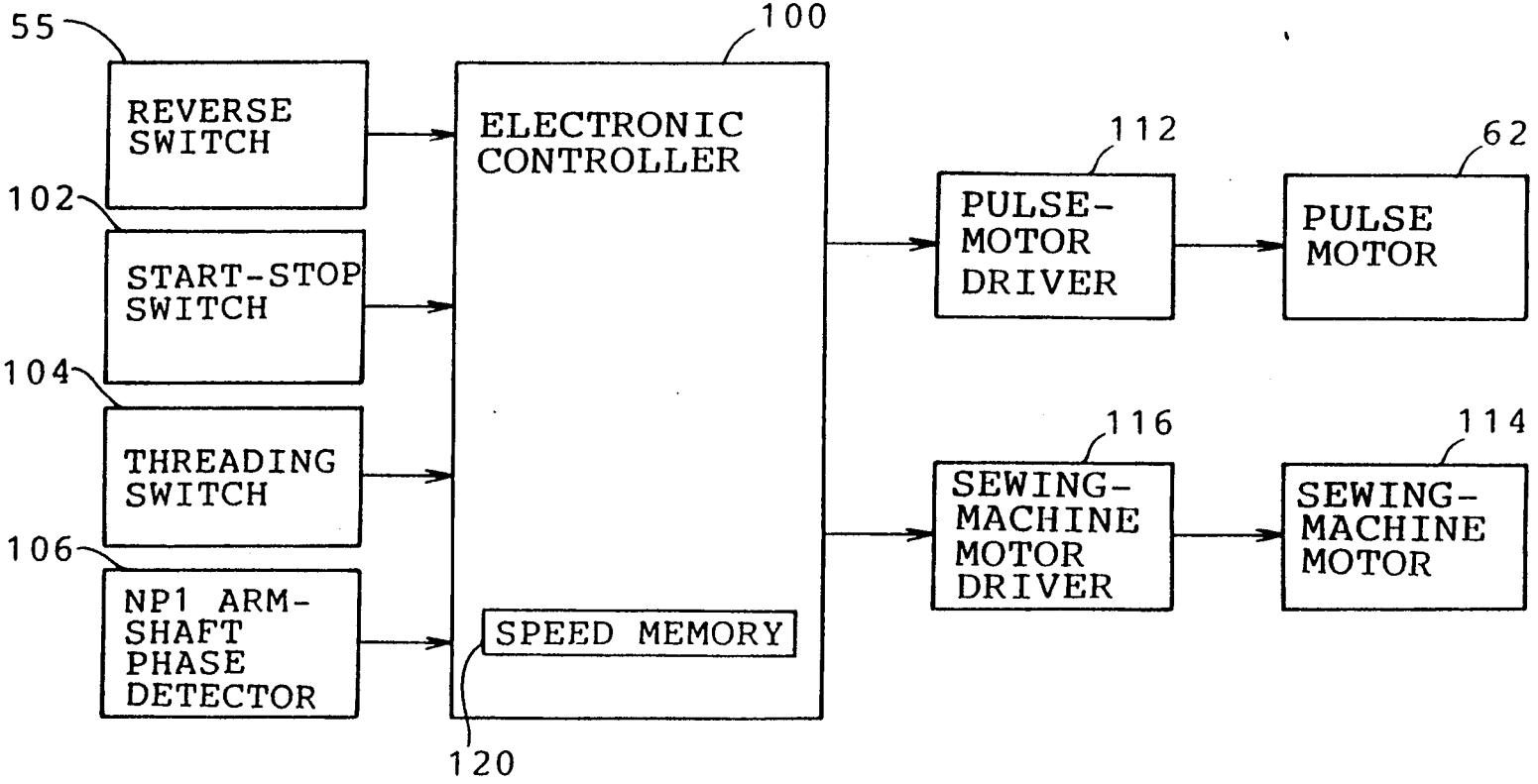
FIG. 10 is a schematic diagram of an electric structure for the embodiment.

As shown in the electric circuit schematic diagram in FIG. 10, an electronic controller 100 controls the threading mechanism for the embodiment. The reverse switch 55, a start-stop switch 102, a threading switch 104, and an NPl arm-shaft phase detector 106 are connected to the electronic controller 100. The reverse switch 55 detects that the threading hook 26 is entering the eye 18*a*. The start-stop switch 102 instructs the start or the stop of sewing operation, and the threading switch 104 instructs threading operation. When the arm shaft 1 rotates and the needle bar 10 rises to its uppermost position, the NPl arm-shaft phase detector 106 detects the corresponding rotational position of the arm shaft 1 and sends out an NPl signal to the electronic controller 100. The electronic controller 100 transmits a control signal to a pulse-motor driver 112, and a sewing-machine motor driver 116. The pulse-motor driver 112 transmits pulses to the pulse motor 62 corresponding to the control signal from the electronic controller 100. The sewing-machine motor driver 116 transmits pulses to a sewing-machine motor 114 corresponding to the control signal from the electronic controller 100. The sewing-machine motor 114 drives and rotates the arm shaft 1. The electronic controller 100 is provided with a predetermined control program and a speed memory 120 for storing a predetermined speed of the pulse motor 62.

Figure 11A:
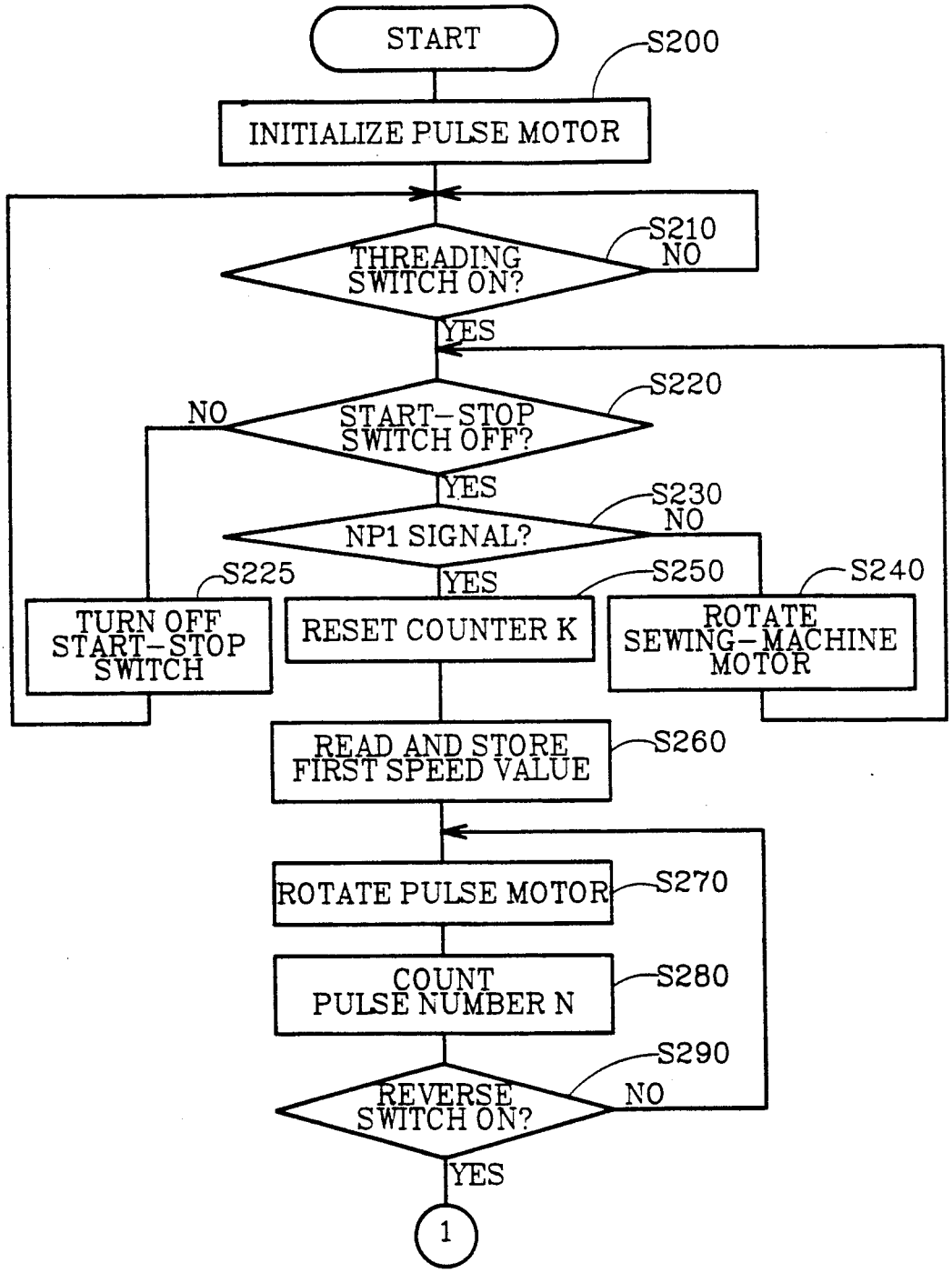
FIGS. 11A and 11B is a flow chart of threading routine executed in a control circuit for the embodiment.
Figure 11B:
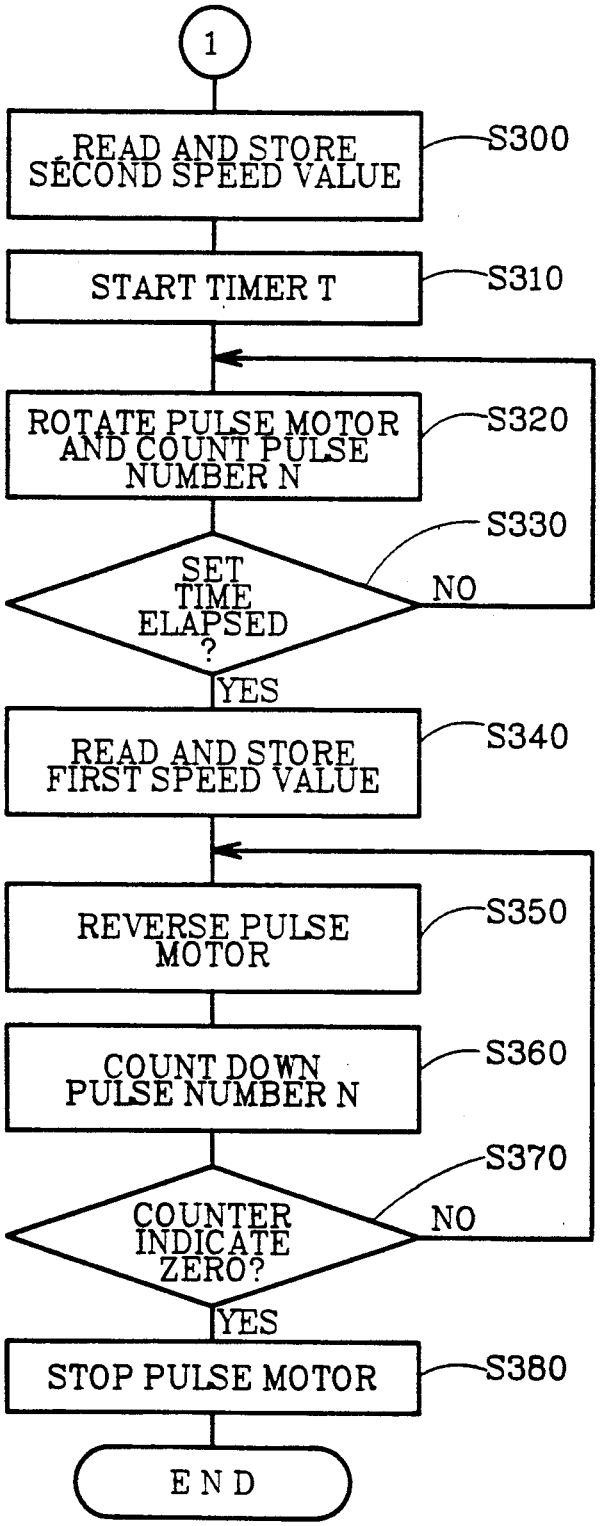

In operation, as shown in the flowchart of FIGS. 11A and 11B, after a power switch (not shown) on the sewing machine is turned on, step S200 initializes the pulse motor 62. An operator presses the threading switch 104 so that the eye 18*a* in the needle 18 is threaded with thread 17 prior to sewing operation. Step S210 determines whether the threading switch 104 is turned on. If at step S210 the threading switch 104 is on, step S220 determines whether the start-stop switch 102 is turned off. If at step S220 the start-stop switch 102 is on and the sewing-machine motor 114 is rotating, step S225 turns off the start-stop switch 102, thereby stopping the sewing-machine motor 114. The process waits for step S210 where the threading switch 104 is turned on again.

If at step S210 the threading switch 104 is on and at step S220 the start-stop switch 102 is off, step S230 determines whether the NPl arm-shaft phase detector 106 transmits the NPl signal to the electronic controller 100. If at step 230 the NPl signal is not issued, step S240 rotates the sewing-machine motor 114, until the NPl signal is issued and the arm shaft 1 is stopped at the rotational position where the needle bar 10 is at its uppermost position and the eye 18*a* can be threaded.

After the needle bar 10 is positioned, step S250 resets a counter K for computing the momentum of the pulse motor 62. Step S260 reads a first speed value from the speed memory 120 for rotating the pulse motor 62 at high speed and stores the first speed value into a temporary speed storage in a RAM (not shown). Based on the first speed value stored in the RAM, step S270 sends pulses to the pulse-motor driver 112 and rotates the pulse motor 62 forward at high speed. When the pulse motor 62 lowers the moving board 48 toward the needle 18, the actuating pin 30 lowers and contacts the projection 20*a*. The threading rod 24 starts rotating in the direction shown by the arrow YA in FIG. 3. The linkage 28 starts stretching out the thread 17 and the threading hook 26 starts rotating.

At step S280 the counter K counts the number N of pulses sent from the pulse-motor driver 112. Step S290 determines whether the reverse switch 55 turns on and the threading hook 26 is ready to enter the eye 18*a* in the needle 18. If at step S290 the reverse switch 55 fails to turn on, steps S270 and S280 are repeated.

If at step S290 the reverse switch 55 turns on, the moving board 48 lowers, the threading hook 26 is ready to go through the eye 18*a*, and the process goes to step S300. Step S300 reads a second speed value from the speed memory 120 for rotating the pulse motor 62 securely at low speed, and stores the second speed value into the temporary speed storage in the RAM. Step S310 starts a timer T on which time period required for causing the threading hook 26 to come through the eye 18*a* and catch the thread 17 is set. After the timer T starts operating, step S320 sends pulses to the pulse-motor driver 112 based on the second speed value, rotates the pulse motor 62 forward at low speed, and counts the number N of the pulses. Consequently, just after the threading hook 26 starts coming through the eye 18*a* in the needle 18, the pulse motor 62 rotates at low speed.

After the pulse motor 62 rotates at low speed, step S330 determines whether the set time period has elapsed on the timer T. If the set time period has not elapsed, step S320 continues rotating the pulse motor 62 at low speed. If at step S330 the set time period has elapsed, the thread 17 is caught in the threading hook 26 as shown in FIGS. 4 and 6. Subsequently, step S340 reads the first speed value from the speed memory 120 and stores the first speed value into the temporary speed storage in the RAM, and step S350 reverses the pulse motor 62 at high speed based on the first speed value. As shown in FIGS. 5, 7 and 8, the threading hook 26 with the thread 17 then leaves the eye 18*a*.

Step S360 counts down the number N of pulses for rotating the pulse motor 62 in reverse, and step S370 determines whether the counter K indicates zero. If at step S370 the counter K indicates zero, step S350 continues reversing the pulse motor 62 at high speed, and step S360 counts down the number N of pulses. On the other hand, if at step S370 the counter K indicates zero, the moving board 48 returns to its uppermost position, and step S380 stops the pulse motor 62. The threading process ends.

In the embodiment, when the threading switch 104 is turned on, steps S200 through S240 put the needle bar 10 in the position where the needle 18 can be threaded. Subsequently, the pulse motor 62 rotates, the linkage 28 applies tension to the thread 17, and the threading hook 26 threads the eye 18*a* with the thread 17 stretched out.

By rotating the pulse motor 62 at a given speed and by a given rotation amount, the threading rod 24 is lowered, tension is applied to the thread 17, and the threading hook 26 is rotated. Consequently, the needle 18 can securely be threaded with the thread 17. Operation errors resulting from manual threading can be avoided, thereby enhancing operation efficiency.

Specifically, when the threading hook 26 rotates and comes through the eye 18*a*, the force of the spring of the threading device increases to maximum against the rotation of the threading hook 26, and the linkage 28 gives maximum tension to the thread 17. When the pulse motor 62 is thus provided with a large load, the rotation speed of the pulse motor 62 is switched from high speed to low speed. Consequently, the pulse motor 62 with large load is prevented from stepping out of rotation, and the needle 18 is securely threaded. For example, when the moving board 48 lowers or rises toward or away from the needle 18 to position the threading rod 24, load on the pulse motor 62 is small, and the pulse motor 62 is rotated at high speed. The moving board 48 quickly moves, thus enhancing threading efficiency.

When the pulse motor 62 rotates forward, the counter K counts the number N of the pulses. When the pulse motor 62 rotates in reverse, the counter K counts down the number N. When the counter K indicates zero, the pulse motor 62 is stopped. Consequently, the pulse motor 62 can be stopped without using a sensor for detecting that the moving board 48 reaches its uppermost position. The number of components of the threading device is thus reduced.

In the embodiment, the threading operation to the point at which the reverse switch 55 is turned on is controlled separately from threading operation after the reverse switch 55 is turned on. The rotation amount of the pulse motor 62 after the reverse switch 55 is turned on is set on the timer T. Time period from when the threading hook 26 enters the eye 18*a* to catch the thread 17 until the threading hook 26 with the thread 17 leaves the eye 18*a* is set on the timer T. Specifically, the time period is preset on the timer T appropriately, by considering step-out of the pulse motor 62 and time required for securely hooking the thread 17, such that rattles resulting from the step-out of the pulse motor 62 can be reduced and the needle 18 can be securely threaded. On the other hand, if the needle bar 10 is stopped at any position and the number N of pulses required from when the pulse motor 62 starts rotating until the pulse motor 62 reverses, the counter K can control the number N of pulses appropriately. Consequently, the pulse motor 62 can be prevented from rattling a the needle bar 10 can be positioned in wide range.

This invention has been described above with reference to the preferred embodiment. Modifications and alterations may become apparent to one skilled in the art upon reading and understanding the specification. It is intended to include all such modifications and alterations within the scope of the appended claims.

In this embodiment, the pulse motor 62 is operated for secure control and decrease in reduction ratio of transmission. However, a DC motor for reducing cost and a limit switch for detecting the moving board 48 in its uppermost position can replace the pulse motor 62. When the load on the pulse motor 62 increases, supply voltage to the pulse motor 62 can be increased. Since in this embodiment the needle bar 10 is accurately put in its uppermost position, the reverse switch 55 can be omitted, and instead the number N of pulses can be counted for determining when the pulse motor 62 reverses.

What is claimed is:

1. A threading device for threading a needle, comprising:

stretching and holding means for holding and applying tension to a thread;

moving means for moving the stretching and holding means such that the thread is located adjacent to an eye of a needle;

threading means for threading the tensioned thread located adjacent to the needle through the eye of the needle;

actuating means for driving the moving means and threading means upon receiving a threading instruction; and an electric drive means which drives the stretching and holding means to stretch the thread.

2. The threading device of claim 1, wherein the stretching means comprises:

a stretching member rotatably fixed at a fixing point;

rotating means for rotating the stretching member about the fixing point;

tensioning means for holding the thread; and a holding hook attached to a first end of the stretching member for holding the thread; wherein when the rotating means rotates the stretching member about the fixing point into a threading position, the tensioning means and the holding hook hold the thread adjacent to the eye of the needle with tension.

3. The threading device of claim 1, wherein the threading means comprises:

a threading member rotatably fixed at a fixing point;

a threading hook attached to a first end of the threading member; wherein when the threading member rotates in one direction about the fixing point into a threading position, the threading hook penetrates the eye of the needle and hooks the thread; and when the threading member rotates in an opposite direction about the fixing point, the threading member withdraws the threading hook from the eye of the needle, thereby pulling the thread through the eye of the needle.

4. The threading device of claim 1, wherein the moving means comprises a threading rod axially rotatable about a threading rod axis, where the holding means is fixed to a first end of the threading rod such that, when the threading rod rotates in a first direction, the holding means is rotated about the threading rod axis and holds the thread with tension adjacent to the eye of the needle.

5. The threading device of claim 4, wherein the actuating means comprises:

a closed actuating cylinder coaxially mounted around the second end of the threading rod and having a slot formed thereon;

driving means for moving the actuating cylinder along the threading rod axis;

an actuating pin secured to the threading rod and protruding through the slot in the actuating cylinder; and a compression spring interposed between the closed end of the actuating cylinder and the actuating pin; wherein when the driving means moves the actuating cylinder along the threading rod axis to compress the compression spring, the slot acts on the actuating pin to rotate the actuating pin and threading rod in the first direction around the threading rod axis.

6. The threading device of claim 1, wherein the electric drive means comprises a pulse motor.

7. A threading device for threading a needle, comprising:

a threading rod axially rotatable about a threading rod axis;

a stretching member fixed to a first end of the threading rod;

a holding hook for holding the thread mounted on a first end of the stretching member;

tensioning and holding means for holding the thread, such that the thread is held with tension between the holding hook and the tensioning and holding means;

threading means rotatably attached to the threading rod for threading a thread through an eye of the needle when the thread is adjacent to the eye of the needle;

actuating means for rotating the threading rod in a first direction about the threading rod axis upon receiving a threading instruction such that the holding hook and tensioning and holding means hold the thread with tension in a threading position adjacent to the eye of the needle; and a driving means and a speed control means to control the speed of the driving means.

8. The threading device of claim 7, wherein, when the stretching member rotates about the needle rod axis into the threading position, the needle is between the holding nook and the needle rod axis.

9. The threading device of claim 8, wherein the threading means comprises:

a threading member rotatably mounted on the threading rod;

a threading hook mounted on one end of the threading member; and linkage means for connecting the stretching member to the threading member such that threading member rotates about the needle rod axis in a direction opposite to the stretching member; such that when the needle rod rotates the holding member in the first direction about the needle rod axis, the threading hook and tensioning means hold the thread in the threading position and the linkage means rotates the threading member in a second direction about the needle rod axis such that the threading hook penetrates the eye of the needle and hooks the thread being held in the threading position.

10. The threading device of claim 8, wherein the actuating means comprises:

a closed actuating cylinder coaxially mounted around the second end of the threading rod and having a slot formed thereon;

driving means for moving the actuating cylinder along the threading rod axis;

an actuating pin secured to the threading rod and protruding through the slot in the actuating cylinder; and a compression spring interposed between a closed end of the actuating cylinder and the actuating pin; wherein the driving means moves the actuating cylinder in a first direction along the threading rod axis to compress the compression spring upon receiving the threading instruction such that the slot acts on the actuating pin to rotate the actuating pin and threading rod in the first direction around the threading rod axis.

11. The threading device of claim 10, wherein the driving means moves the actuating cylinder in the first direction for a predetermined time period, after which the driving means moves the actuating cylinder in a second direction along the threading rod axis.

12. The threading device of claim 11, wherein when the driving means moves the actuating cylinder in the second direction:

the slot acts on the actuating pin to rotate the actuating pin, threading rod, and stretching member in the second direction about the needle rod axis to retract the stretching member away from the needle; and the linkage means rotates the threading member in the first direction about the needle rod axis to withdraw the threading hook from the eye of the needle, such that the threading hook pulls the thread through the eye of the needle.

13. The threading device of claim 7, wherein the speed control means controls the speed according to data stored in a speed control memory.

14. A threading device for a sewing machine having a needle bar, a needle attached to one end of the needle bar, and a sewing transmission for moving the needle bar, the threading device comprising:

a threading rod mounted in parallel to the needle bar such that the threading rod is movable along and rotatable about an axis of the threading rod;

a stretching member fixed to a first end of the threading rod;

a holding hook attached to a first end of the stretching member for holding the thread;

tensioning means for holding the thread, such that the thread is held between the holding hook and the tensioning means with tension;

threading means rotatably attached to the threading rod for threading a thread through an eye of a needle when the thread is adjacent to the eye of the needle;

actuating means mounted on a second end of the threading rod for rotating the threading rod in the first direction about the threading rod axis when the actuating means moves relative to the threading rod;

drive means for moving the actuating means and threading rod towards the threading position upon receiving a threading instruction; and stop means mounted on the needle bar for stopping the threading rod when the threading rod is in the threading position; wherein the drive means moves the actuating means relative to the threading rod after the threading rod is in the threading position; and when the threading rod rotates in a first direction about the threading rod axis, the stretching member rotates in a first direction about the threading rod axis such that the thread is held with tension adjacent to an eye of the needle.

15. The threading device of claim 14, wherein the drive means drives the actuating means and threading rod at a first speed until the threading rod is in the threading position and drives the actuating means relative to the threading rod at a second speed after the threading rod is in the threading position.

16. The threading device of claim 15, wherein the drive means comprises:

a pulse motor for providing rotational motion;

a transmission for transferring the rotational motion of the pulse motor into linear motion for driving the actuating means; and counting means for counting a movement number of pulses needed to move the threading rod into the threading position; wherein the drive means further drives the actuating means away from the threading position by applying the movement number of pulses.

17. The threading device of claim 16, wherein, after the threading rod is in the threading position, the driving means moves the actuating cylinder relative to the threading rod in the first direction along the threading rod axis for a predetermined time period, after which the driving means moves the actuating cylinder in a second direction along the threading rod axis.

18. The threading apparatus of claim 17, wherein:

the actuating means comprises an actuating cylinder having one closed end mounted on the second end of the threading rod such that the threading rod reciprocates within the actuating cylinder;

the threading rod further comprises an actuating pin fixed to and radially extending from the threading rod through a slot in the actuating cylinder; and the threading apparatus further comprises an elastic member mounted within the actuating cylinder between the closed end of the actuating cylinder and the actuating pin such that the elastic member forces the threading rod towards the threading position; wherein the slot is formed in the actuating cylinder such that the slot acts on the actuating pin to rotate the threading rod when the actuating cylinder moves relative to the threading rod.

* * * * *